US006398605B1

(12) United States Patent
Gibbons et al.

(10) Patent No.: US 6,398,605 B1
(45) Date of Patent: Jun. 4, 2002

(54) SWIM FIN

(76) Inventors: John D. Gibbons, 355 Chestnut Hill, Wakefield, RI (US) 02879; Dennis E. Gibbons, 5 Maple St., Hope Valley, RI (US) 02832

( * ) Notice: Subject to any disclaimer, the term of this patent is extended or adjusted under 35 U.S.C. 154(b) by 0 days.

(21) Appl. No.: 09/964,317

(22) Filed: Sep. 26, 2001

Related U.S. Application Data

(60) Provisional application No. 60/235,586, filed on Sep. 27, 2000.

(51) Int. Cl.[7] ..... A63B 31/08
(52) U.S. Cl. ..... 441/64
(58) Field of Search ..... 441/64, 61; D21/806

(56) References Cited

U.S. PATENT DOCUMENTS 2,343,468 A * 3/1944 Messinger ..... 441/64
2,980,926 A * 4/1961 Wolshin ..... 441/64
5,358,439 A * 10/1994 Paolo ..... 441/64

FOREIGN PATENT DOCUMENTS

FR 2505663 * 11/1982 ..... 441/64

* cited by examiner

*Primary Examiner*—Ed Swinehart
(74) *Attorney, Agent, or Firm*—DeWitt Ross & Stevens SC; Charles S. Sara

(57) ABSTRACT

A swim fin is provided that is placed between a user's foot and the sole of a foot covering. The fin is generally planar and fin-shaped, having a heel end and a toe end, with opposing lateral sides extending between the toe end and the heel end. An optional tab(s) is located at one of the lateral sides and spaced distantly from the toe end, and may terminate in a enlarged terminal end that projects inwardly. A groove is formed between the tab and the heel end. Binding members, such as straps of a sandal, are inserted into the groove.

22 Claims, 4 Drawing Sheets

SWIM FIN

CROSS REFERENCE TO RELATED APPLICATIONS

This application claims priority under 35 USC §119(e) to U.S. provisional patent application serial. No. 60/235,586, filed Sep. 27, 2000, the entirety of which is incorporated by reference herein.

FIELD OF THE INVENTION

The invention relates to flippers or fins for scuba diving, boogie boarding, snorkeling, water sports, and swimming.

BACKGROUND OF THE INVENTION

Swim fins are used for scuba diving, snorkeling, and swimming. Typically, fins include a fan-shaped portion for propulsion in a water environment. Conventional fins also include a structure to attach the fin to a user's foot. The attachment structures can be divided into shoe-like structures such as foot pockets and sandal-like structures such as straps. A user inserts a foot into the attachment structure and attaches the fin to the foot. Attachment structures typically have multiple parts, many of which are breakable.

Conventional fins are difficult to walk in, and provide limited resistance or traction for wading into bodies of water. Conventional fins are usually sport specific and expensive, because they lack the flexibility of use to encompass a wide range of water sports.

Additionally, conventional style fins tend to be ill-fitting, and fall off easily, particularly on children. It is expensive for parents to replace fins as the child's foot grows, thus using fins is difficult for children, and fins are easily lost as the child swims.

Fins are most often used by recreational swimmers, divers, and vacationers. Space is often limited when traveling, and conventional fins are bulky and thus require a considerable amount of space in luggage and storage. As an alternative to fins, vacationers oftentimes travel with sandals or other shoes that can be worn while scuba diving, snorkeling, and swimming instead of fins. However, this does not provide the additional propulsion that fins provide.

SUMMARY OF THE INVENTION

The invention, which is defined by the claims set out at the end of this disclosure, is intended to solve at least some of the problems noted above. A fin is provided that preferably lacks any attachment structure that are shoe-like, such as foot pockets, or sandal-like, such as straps. Thus, unlike previous fins, the fin described herein is not secured to a user's foot. Instead, it is placed between a foot and a sandal, shoe, or other foot covering. This provides a much more secure fit, and makes walking in fins much easier.

More specifically, the present invention is directed to a swim fin for placement in a foot covering, where the foot covering includes a heel edge and an open toe edge. The swim fin comprises a generally planar member with a first toe end extending beyond the toe edge of the foot covering, a second heel end opposite the first end, wherein the second end is narrower than the first for placement in the foot covering, and opposing lateral sides extending between the first toe end and the second heel end. The opposing lateral sides define a foot placement area.

The present invention is also directed to a swim fin for placement in a foot covering, wherein the foot covering includes a heel edge and an open toe edge. The swim fin comprises a generally planar member with a first toe end extending beyond the toe edge of the foot covering; a second heel end opposite the first end, wherein the second end is narrower than the first for placement in the foot covering; opposing lateral sides extending between the first toe end and the second heel end, wherein the opposing lateral sides define a foot placement area; and at least one, and preferably two, tabs extending outwardly from one of the lateral sides at a location spaced distantly from the toe end, wherein the first toe end, the second heel end, and the tab are all in the same plane.

Another version of the fin includes a foot covering including an at least substantially planar sole and binding members extending upwardly from the sole. The binding members are situated about the sole so as to receive a user's foot therein and bind the foot to the sole. The fin also includes an at least substantially planar body member including a toe end, a heel end opposite the toe end, and opposing lateral sides that extend between the toe end and the heel end. The width of the body member between the lateral sides is such that a portion of the body member adjacent the heel end may rest between the binding members in at least substantially parallel relation to the sole. A user's foot may be received within the binding members of the foot covering with the body member situated between the user's foot and the sole of the foot covering. This version of the fin can also include at least one tab as described above.

All of the versions described above can also include a raised arch-support area located between the toe end and the heel end. The raised area is complementary to a built-in arch in a foot covering, such as a TEVA-brand sandal. Thus, this version of the fin can be worn with these types of foot coverings.

All of the versions of the fin can also include a flange that projects from the heel end at approximately a right angle. The flange can project upwardly or downwardly. The downwardly projecting flange helps secure the fin to the sandal by pressing it against the heel of the sandal. The upwardly projecting flange helps fix the fin in place by pressing it against the user's heel.

The objects and advantages of the invention will appear more fully from the following detailed description of the preferred embodiment of the invention made in conjunction with the accompanying drawings.

DETAILED DESCRIPTION OF THE INVENTION

Figure 1:
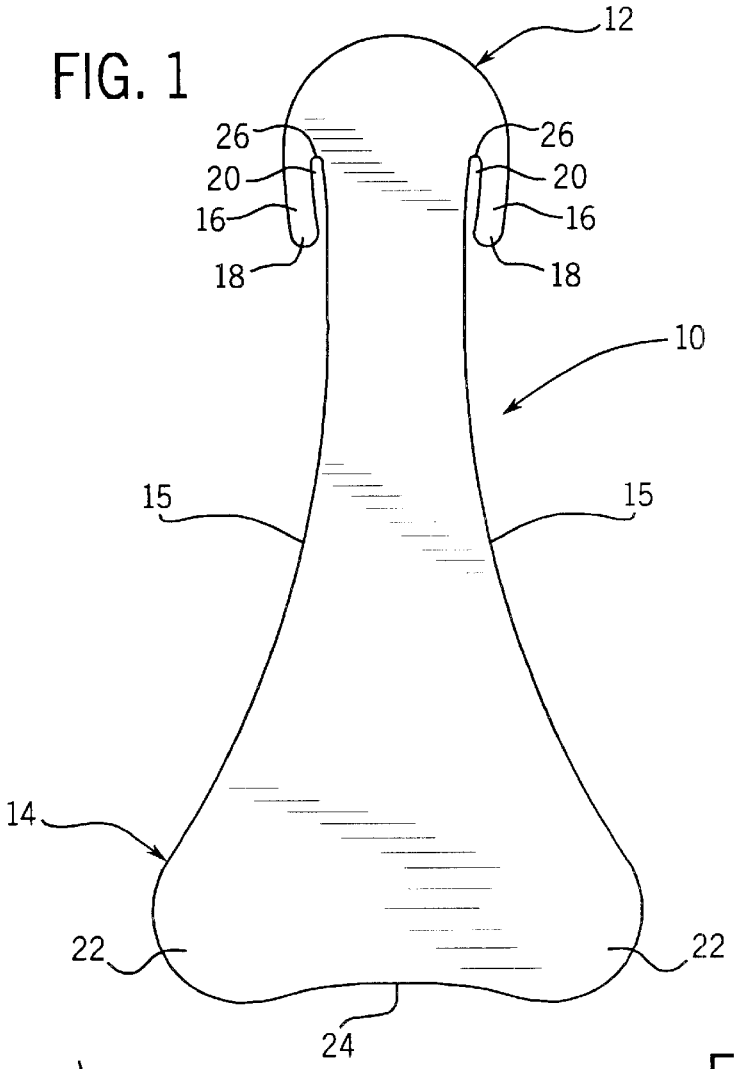
FIG. 1 is a top plan view of a first preferred embodiment of a fin.

In the drawings, a first preferred embodiment of the fin is illustrated in FIG. 1 at reference numeral 10. The fin 10 is preferably made from a single piece of material, such as high density polyethylene or a polycarbonate-resin sheet material, such as LEXAN-brand polycarbonate. Alternatively, another material, such as plastic, a synthetic resinous composition or the like, is used to make the fin 10. Preferably, the fin 10 is cut out of the material from which it is made. However, other methods of fabrication known to the art, such as molding, can be used.

Unlike conventional fins, the fin 10 described herein is not secured to a user's foot. Instead, it is placed between a foot and a foot covering. For purposes of the present invention, the term "foot covering" is meant to include any covering for a foot preferably having a open toe to allow one end of the swim fin to extend beyond the user's foot. Non-limiting examples of foot coverings include sandals and shoes, with strapped sandals being the preferred foot covering. The description of the present invention will be made with reference to sandals, and particularly sandals comprising binding straps for attaching the foot to the sole of the sandal. The fin 10 is readily attachable to and removable from the foot covering.

Figure 2:
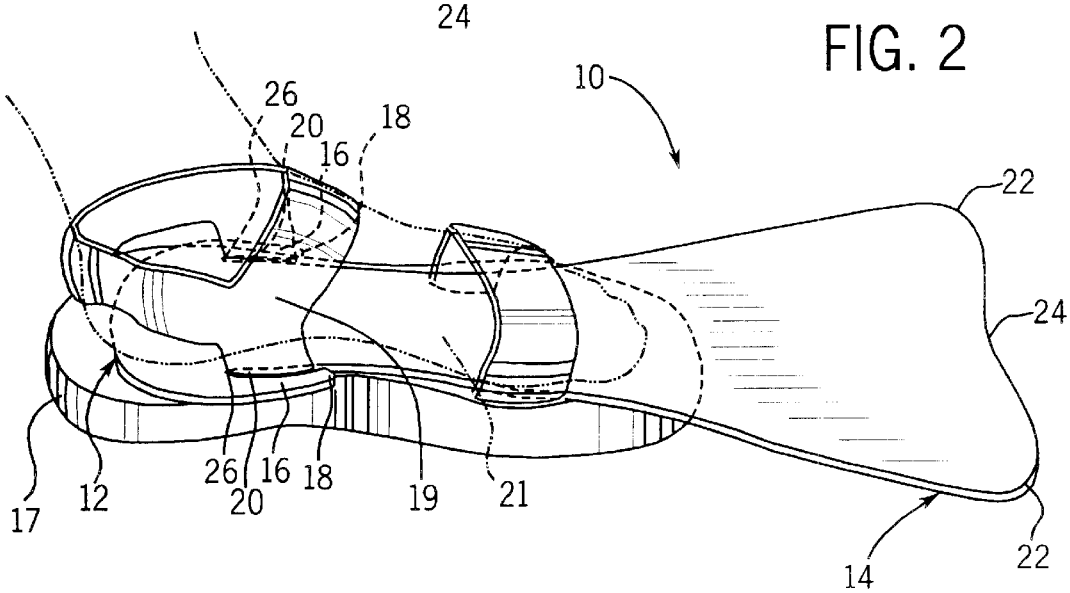
FIG. 2 is a perspective view of the first preferred embodiment of the fin of FIG. 1 engaged to a sandal.
Figure 1A:
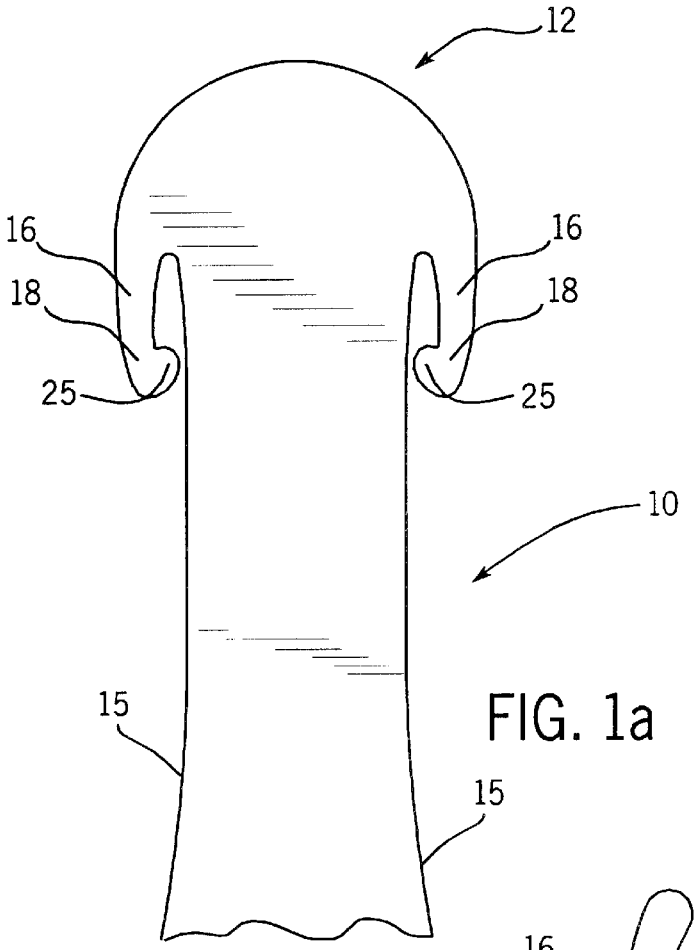
FIG. 1*a* is a partial top plan view of an alternative embodiment of FIG. 1.

Referring to FIGS. 1, 1*a* and 2, a first preferred embodiment of the fin 10 is generally planar and fan-shaped, having a heel end 12 and a toe end 14, and opposing lateral sides 15 extending between the toe end 14 and the heel end 12. Also included are means to releasibly attach the swim fin 10 to a sandal 17. While it is within the scope of the present invention to include a variety of attaching devices, such as removable clips, hook and loop (VELCRO) fasteners and the like, the preferred means are two opposing tabs 16, with each tab 16 protruding outwardly from one of the lateral sides 15. In this the preferred embodiment, each tab 16 is located rearwardly at the heel end 12 and extends toward the toe end 14. Each tab 16 is spaced distantly from the toe end 14 and terminates at an terminal end 18. As illustrated in FIG. 1*a*, the terminal end 18 can optionally include an enlarged portion 25, to assist in hooking the tab 16 to a sandal strap 19. A groove 20, which terminates in a valley 26, is formed between the tab 16 and the heel end 12.

Referring to FIG. 2, the sandal strap 19 is inserted into the groove 20. The terminal end 18 and the pressure of the user's foot, illustrated at 21 in phantom, prevents the fin 10 from slipping rearwardly. The toe end 14 is broader than the heel end 12, which increases the surface area contacting the water as the user kicks in the water. The preferred dimensional relationship of the width of the toe end 14 to the width of the heel end 12 is that the toe end 14 width is approximately from 150% to 250% of the heel end 12 width, with 200% being more preferred. The toe end 14 optionally includes two protrusions 22 and an indent 24 between the two protrusions 22. The protrusions 22 are located at the terminal end of the toe end 14.

The use of the fin 10 will now be described using the sandal 17 as a foot covering example to illustrate the invention. This description is not intended to limit the fin 10 to one that can be used with the sandal 17. The fin 10 described herein can be used with a shoe or any other foot covering that has the appropriate binding members. FIG. 2 shows the fin 10 attached to the sandal 17. To insert the fin 10 into the sandal 17, the heel end 12 of the fin 10 is inserted into the sandal 17 between its straps 19 starting at the sandal's toe edge. The fin 10 is horizontally slid with respect to the sole of the sandal 17 to insert the fin 10 between the sandal's vertical straps, as by pushing the heel end 12 rearwardly past the sandal's heel. When the terminal end 18 is moved past the vertical strap 19 on the sandal's 17 heel end, the rearward pushing of the fin 10 ceases. Then, the sandal's vertical straps 19 are pushed inwardly against the heel end 12 of the fin 10 to prevent the straps 19 from blocking movement of the fin 10. The fin 10 is pulled forward until the valley 26 of the groove 20 contacts the sandal's vertical straps 19. The straps 19 are thus engaged in the grooves 20. The terminal end 18 prevents rearward slippage of the fin 10. To fully engage the fin 10 with the sandal 17, it might be necessary to push the fin 10 downwardly toward the sandal's sole. The user can then enter the water to scuba dive, snorkel, and/or swim.

Once the user leaves the water, the fin 10 can be easily removed from the sandal 17 by taking the sandal 17 off the foot 21 and initially pushing the fin 10 rearwardly toward the sandal's heel end, preferably while pushing the sandal's vertical straps 19 toward each other. It might be necessary to lift the fin 10 up off the sole of the sandal 17 to facilitate this movement. After the tab 16 is moved back beyond the sandal's vertical strap 19, the fin 10 is moved toward the sandal's toe end and past the sandal straps that retain the ball of the foot 21. This movement releases the fin 10 from the sandal.

The fin 10 is symmetrical about its central axis such that it fits into a foot cover for either foot of a user. The user simply flips the fin 10 about its central axis to position it in a sandal for the opposite foot. Thus, in one orientation, the fin 10 fits into the right sandal, and in the other orientation, the fin 10 fits into the left sandal. Alternatively, the sandal 10 can be perfectly symmetrical, as illustrated. In this manner, it makes no difference on which sandal the fin 10 fits.

The fin 10 preferably is one size that can fit all-sized sandals, shoes, and the like. The distance from the end of the sandal to the end of the fin 10 is variable. Using the fin 10 with a foot covering of a typical size results in about 5 inches of the fin 10 extending beyond the foot covering. When the fin 10 is used with a larger foot covering, then approximately one to four inches of the fin 10 projects beyond the foot covering. When the fin 10 is used with a smaller foot covering, such as a child's sandal, for example a child's size 8, then approximately six inches of the fin 10 projects beyond the foot covering. Thus, the fin 10 has certain preferred dimensional relationship. For a fin 10 that is 15.5 inches long, the length of the fin 10 is from about 115% (compared to the larger foot covering) to about 200% (compared to the smaller foot covering) of the length of the foot covering. The length of the fin 10 compared to the typically-sized foot covering is about 150%. While the preferred embodiment of the fin 10 calls for "one size fits all," it is of course within the scope of the present invention for the fins 10 to be made of different sizes. For example, a child's size fin, shorter in length than that discussed above, can easily be made if it is determined that the projecting portion of the fin should be shorter. Alternatively, the fin can be made longer than the suggested size for increased thrust.

Figure 2A:
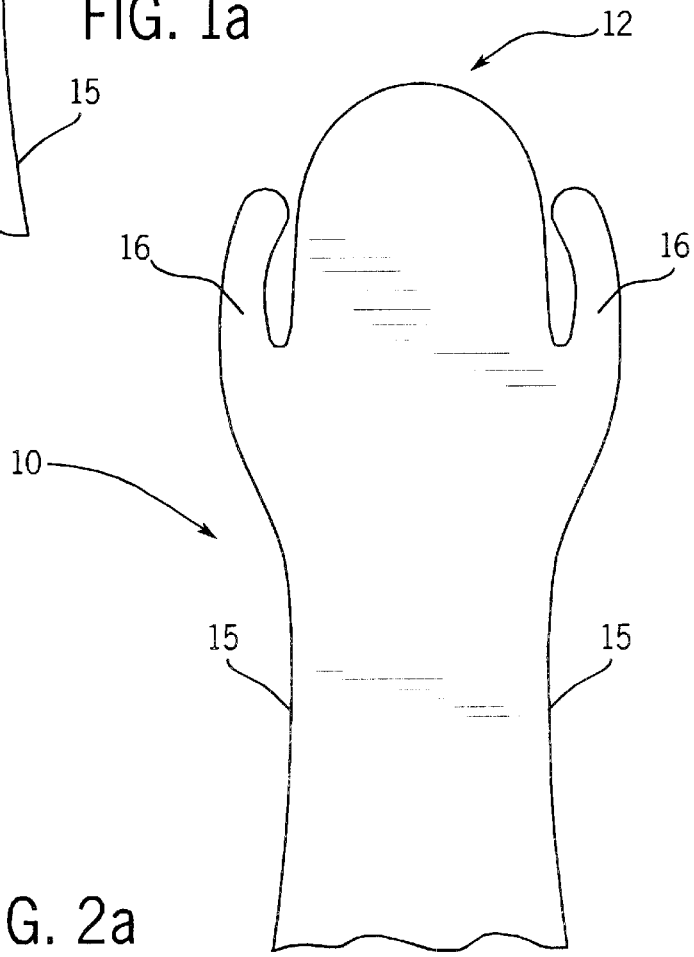
FIG. 2*a* is a partial top plan view of a second alternative embodiment of FIG. 1.

Illustrated in FIG. 2*a* is an alternative embodiment of the fin 10 shown in FIG. 1*a*, in which the opposing tabs 16 extend in the opposite direction, i. e., away from the toe end 14.

Figure 3:
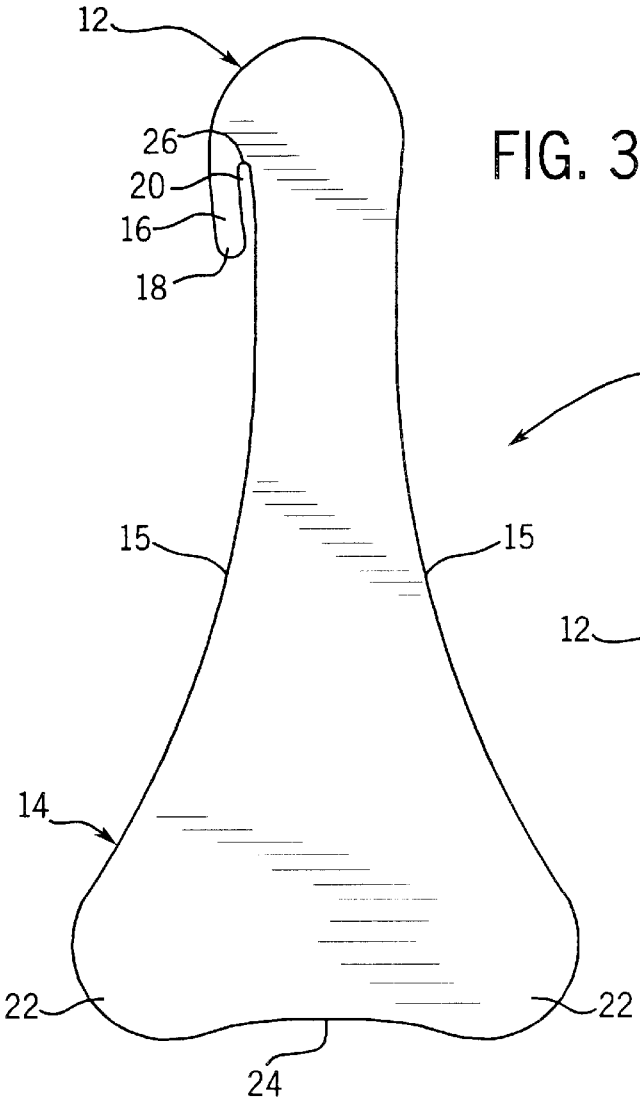
FIG. 3 is a top plan view of a second preferred embodiment of the fin.

Referring to FIG. 3, a second preferred embodiment of the fin 10 is illustrated. The embodiment is similar to the embodiment of FIGS. 1 and 2 with the exception that it only includes one tab 16. Thus, there is one securing mechanism for holding the strap 19 of the sandal 17 to the fin 10. Similarly, to the fin 10 illustrated in FIG. 2*a*, it is within the scope of the present invention to provide a fin 10 with one tab 16 extending away from the toe end 14.

Figure 4:
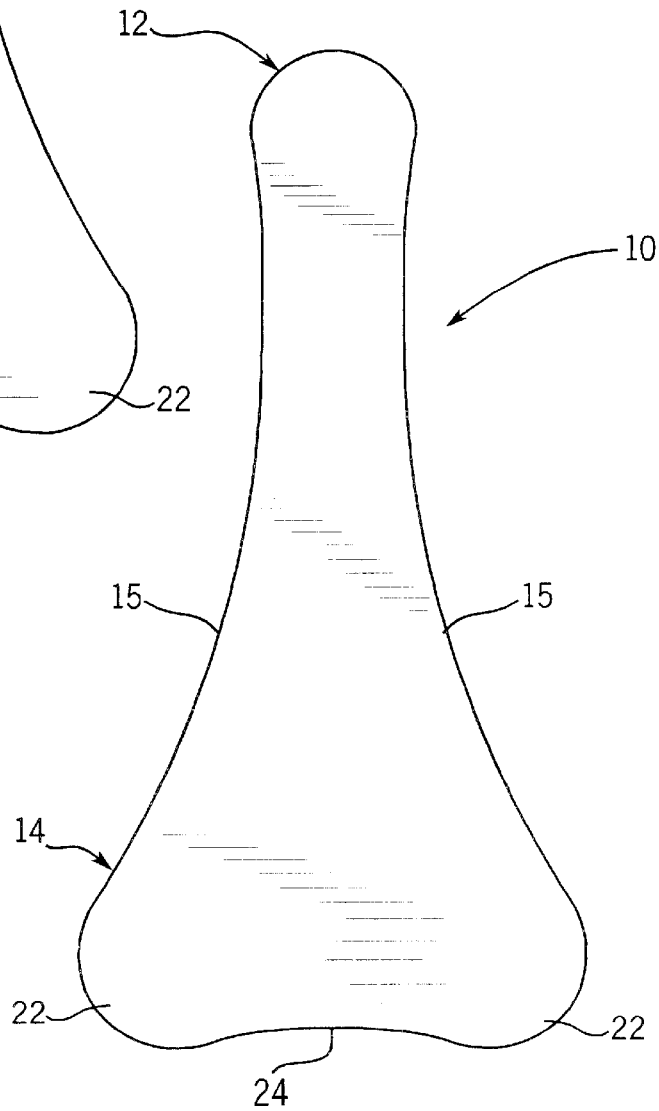
FIG. 4 is a top plan view of a third preferred embodiment of the fin.
Figure 4A:
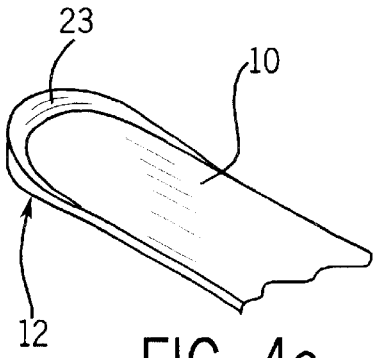
FIG. 4*a* is a perspective view of another embodiment of FIG. 4.

A third preferred embodiment of the fin 10 is illustrated at FIG. 4. This embodiment lacks either tab 16 of the first two preferred embodiments. Thus, no groove 20 is formed between the tab 16 and the heel end 12. In place of the tab 16 and groove 20, the third preferred embodiment may include a slight flange 23, illustrated in FIG. 4*a*, located at the heel end 12 of the fin 10. The flange can project upwardly, as illustrated in FIG. 4*a*, or downwardly. The upwardly projecting flange 23 helps fix the fin in place by abutting the user's heel when the fin 10 shifts forward. Additionally, downward pressure from the foot keeps the fin 10 in place. The downwardly projecting flange 23 helps secure the fin to the sandal by abutting the heel of the sandal. Additionally, downward pressure from the user's foot keeps the fin 10 in place. Although not illustrated in the other figures, it is within the scope of the present invention to augment any of the embodiments disclosed herein to add the flange 23 feature.

Figure 5:
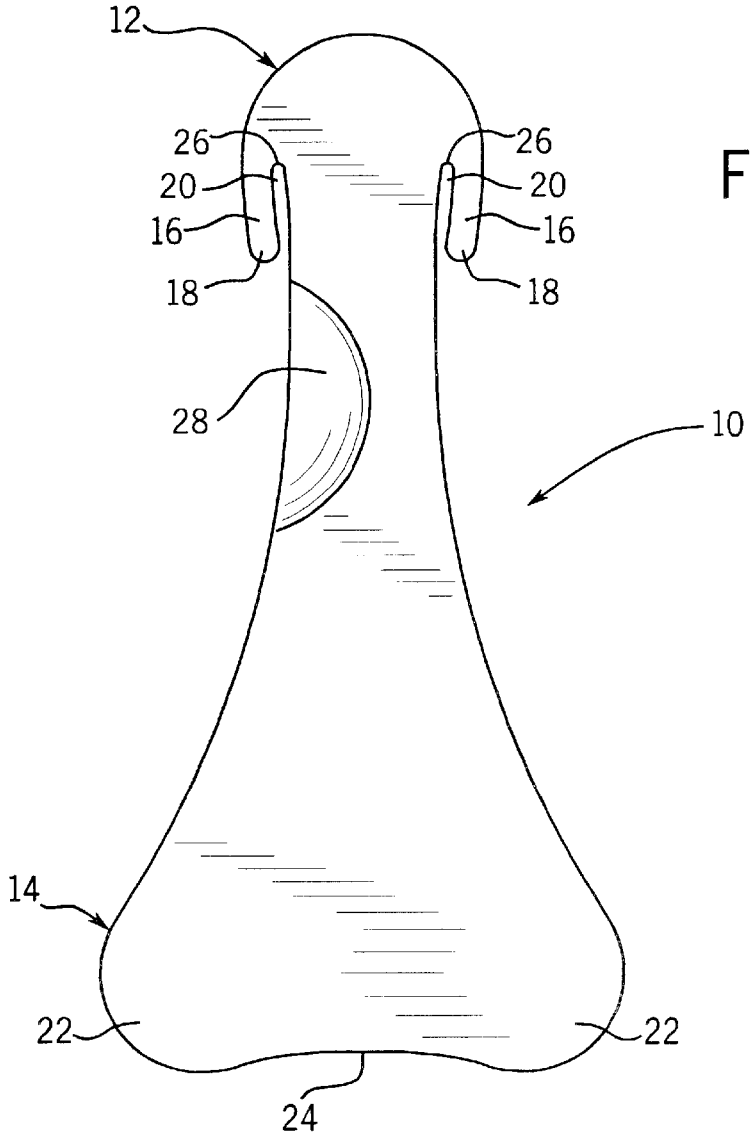
FIG. 5 is a top plan view of a fourth preferred embodiment of the fin.
Figure 6:
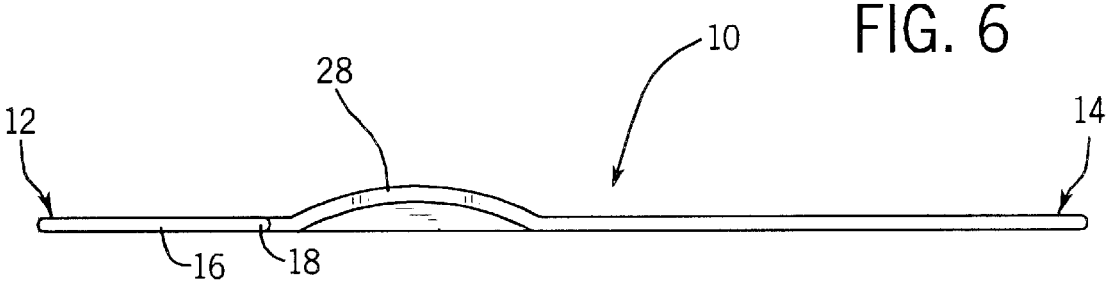
FIG. 6 is a side plan view of the fourth preferred embodiment of the fin.

Referring to FIGS. 5 and 6, a fourth preferred embodiment of the fin 10 is like the first preferred embodiment except that it include a raised area 28 that is located between the toe end 14 and heel end 12 of the fin 10. The raised area 28 is complementary to the arch built into many foot coverings. Accordingly, the fourth preferred embodiment of the fin 10 is compatible with foot coverings having arches built therein. Because of the raised area 28, the fourth preferred embodiment of fin 10 is not ambidextrous, and it does not fit all shoe sizes. Instead, this embodiment of the fin 10 fits a range of shoe sizes. This embodiment is also adaptable for implementation to the other embodiments disclosed herein. While the raised area 28 is illustrated as being molded into the fin 10, it is also within the scope of the present invention to include a built-up arch section (not illustrated) on the flat fin illustrated in FIGS. 1–4.

There are several advantages of the embodiments of the fin 10 shown in the FIGS. 1 through 6. The first advantage is that the fin 10 is much easier to walk in than conventional fins because the sole of the sandal 17 provides increased maneuverability and traction, not found in a conventional fin. Another advantage is that the fin 10 is much more economical because it can be used in a wide range of water sports, and can accommodate children's feet as they grow without replacement. An additional advantage is that the fin 10 provides a close fit and stays attached to the foot while swimming because it attaches firmly to the sandal 17, not the foot 21. In addition, the fin 10 is very portable and fits easily into a suitcase, backpack, other bag, or even a pocket. It is also lightweight and easy to dry because of its generally planar shape and the absence of straps and/or a foot pocket.

It is understood that the various preferred embodiments are shown and described above to illustrate different possible features of the invention and the varying ways in which these features may be combined. Apart from combining the different features of the above embodiments in varying ways, other modifications are also considered to be within the scope of the invention. Certain preferred modifications follow.

First, for additional ways to secure the fin 10 to a foot covering, the fin 10 can include both the tab(s) 16. The tab 16 may terminate in an enlarged terminal end 18.

Second, the terminal end of the toe end 14 can be shaped as is shown in FIGS. 5 and 6. That is, the terminal end can have pointed corners between which is a gently sloped curve.

Third, the fin 10 can be inserted between the foot covering and a user's foot with no additional way of attaching the fin to the foot covering. For example, the version of the fin 10 includes no tab(s) 16, which terminates in an inwardly projecting enlarged terminal end 18 and no flange 23.

Fourth, the fin 10 can include a tab(s) 16 located forwardly of the heel end 12. The tab(s) 16 project rearwardly back toward the heel end 12 and engage the binding members of the foot covering.

Fifth, the fin 10 can include multiple tabs 16 on each side of the sandal. For instance, for use with a sandal having two sets of vertical straps including a rearward set for engaging the part of the foot near the leg and a forward set for engaging the ball of the foot, a tab 16 is provided that engages the rearward strap and a tab 16 is provided that engages the forward strap.

The invention is not intended to be limited to the preferred embodiments described above, but rather is intended to be limited only by the claims set out below. Thus, the invention encompasses all alternate embodiments that fall literally or equivalently within the scope of these claims.

What is claimed is:

1. A swim fin for placement in a foot covering, wherein the foot covering includes a heel edge and an open toe edge, the swim fin comprising a generally planar member, the planar member comprising:

a first toe end extending beyond the toe edge of the foot covering;

a second heel end opposite the first end, wherein the second end is narrower than the first for placement in the foot covering;

opposing lateral sides extending between the first toe end and the second heel end, wherein the opposing lateral sides define a foot placement area;

at least one tab extending outwardly from one of the lateral sides at a location spaced distantly from the toe end, wherein the first toe end, the second heel end, and the tab are all in the same plane; and a flange extending from the second heel end of the swim fin.

2. The swim fin of claim 1, wherein the tab further comprises an enlarged terminal end.

3. The swim fin of claim 1, wherein the tab is located at the heel end and extends toward the first toe end.

4. The swim fin of claim 1, wherein the fin is symmetrical about its central axis such that it fits into a left or a right foot covering.

5. The swim fin of claim 1, further comprising an arch extension located on the foot placement area, the arch being complementary to the arch of a foot.

6. The swim fin of claim 1, further comprising two tabs, wherein each tab extends outwardly and in opposing relationship from each of the lateral sides of the swim fin at a location spaced distantly from the toe end, wherein the first toe end, the second heel end, and the tab are all in the same plane.

7. The swim fin of claim 1, further comprising a foot covering, the foot covering comprising:

a substantially planar sole; and binding straps extending upwardly from the sole, the binding straps being situated about the sole so as to receive a user's foot therein and bind the foot to the sole, whereby a user's foot may be received within the binding members of the foot covering with the foot placement area of the swim fin situated between the user's foot and the sole of the foot covering.

8. A swim fin for placement in a foot covering, wherein the foot covering includes a heel edge and an open toe edge, the swim fin comprising a generally planar member, the planar member comprising:

a first toe end extending beyond the toe edge of the foot covering;

a second heel end opposite the first end, wherein the second end is narrower than the first for placement in the foot covering;

opposing lateral sides extending between the first toe end and the second heel end, wherein the opposing lateral sides define a foot placement area;

at least one tab extending outwardly from one of the lateral sides at a location spaced distantly from the toe end, wherein the first toe end, the second heel end, and the tab are all in the same plane; and an arch extension located on the foot placement area, the arch extension being complementary to the arch of a foot.

9. The swim fin of claim 8, wherein the tab further comprises an enlarged terminal end.

10. The swim fin of claim 8, wherein the tab is located at the heel end and extends toward the first toe end.

11. The swim fin of claim 8, wherein the fin is symmetrical about its central axis such that it fits into a left or a right foot covering.

12. The swim fin of claim 8, further comprising two tabs, wherein each tab extends outwardly and in opposing relationship from each of the lateral sides of the swim fin at a location spaced distantly from the toe end, wherein the first toe end, the second heel end, and the tab are 11 in the same plane.

13. The swim fin of claim 8, further composing a flange extending from the second heel end of the swim fin.

14. The swim fin of claim 8, further comprising a foot covering, the foot covering comprising:

a substantially planar sole; and binding straps extending upwardly from the sole, the binding straps being situated about the sole so as to receive a user's foot therein and bind the foot to the sole, whereby a user's foot may be received within the binding members of the foot covering with the foot placement area of the swim fin situated between the user's foot and the sole of the foot covering.

15. A swim fin consisting of a generally planar member, the planar member consisting of:

a first toe end;

a second heel end opposite the first toe end, wherein the second end is narrower than the first end;

opposing lateral sides extending between the first toe end and the second heel end, wherein the opposing lateral sides define a foot placement area; and two tabs, wherein each tab extends outwardly and in opposing relationship from each of the lateral sides of the swim fin at a location spaced distantly from the toe end, wherein the first toe end, the second heel end, and the tab are all in the same plane.

16. The swim fin of claim 15, wherein the fin is symmetrical about its central axis such that it fits into a left or a right foot covering.

17. The swim fin of claim 15, wherein the two tab are located proximate to the heel end and extend toward the first toe end.

18. A swim fin comprising a generally planar member, the planar member comprising:

a first toe end;

a second heel end opposite the first toe end, wherein the second end is narrower than the first end;

opposing lateral sides extending between the first toe end and the second heel end, wherein the opposing lateral sides define a foot placement area; and two tabs, wherein each tab extends outwardly and in opposing relationship from each of the lateral sides of the swim fin at a location spaced distantly from the toe end, wherein the first toe end, the second heel end, and the tab are all in the same plane.

19. The swim fin of claim 18, wherein the fin is symmetrical about its central axis such that it fits into a left or a right foot covering.

20. The swim fin of claim 18, further comprising a flange extending from the second heel end of the swim fin.

21. The swim fin of claim 18, further comprising an arch extension located on the foot placement area, the arch being complementary to the arch of a foot.

22. The swim fin of claim 18, wherein the two tab are located proximate to the heel end and extend toward the first toe end.

* * * * *

UNITED STATES PATENT AND TRADEMARK OFFICE

CERTIFICATE OF CORRECTION

PATENT NO. : 6,398,605 B1
DATED : June 4, 2002
INVENTOR(S) : Gibbons et al.

It is certified that error appears in the above-identified patent and that said Letters Patent is hereby corrected as shown below:

Column 3,
Line 17, please delete "a open" and substitute therefor -- an open --.
Line 40, please delete "an terminal" and substitute therefor -- a terminal --.

Column 5,
Line 24, please delete "include" and substitute therefor -- includes --.

Column 7,
Line 32, please delete "11" and substitute therefor -- all --.
Line 34, please delete "composing" and substitute therefor -- comprising --.

Column 8,
Line 10, there should be no paragraph break after the word "location".
Line 18, please delete "tab" and substitute therefor -- tabs --.
Line 43, please delete "tab" and substitute therefor -- tabs --.

Signed and Sealed this

Twenty-sixth Day of November, 2002

*Attest:*

*Attesting Officer*

JAMES E. ROGAN
*Director of the United States Patent and Trademark Office*